US010954106B2

(12) United States Patent
Singaraju

(10) Patent No.: US 10,954,106 B2
(45) Date of Patent: Mar. 23, 2021

(54) ESCALATOR SYSTEM WITH SAFETY SENSOR

(71) Applicant: Otis Elevator Company, Farmington, CT (US)

(72) Inventor: Ravikiran Singaraju, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/537,424

(22) Filed: Aug. 9, 2019

(65) Prior Publication Data

US 2020/0048050 A1 Feb. 13, 2020

(30) Foreign Application Priority Data

Aug. 10, 2018 (IN) ..... 201811030190

(51) Int. Cl.

| | |
|---|---|
| ***B66B 29/00*** | (2006.01) |
| ***B66B 23/24*** | (2006.01) |
| ***B66B 31/02*** | (2006.01) |
| ***B66B 21/02*** | (2006.01) |

(52) U.S. Cl.

CPC ..... *B66B 29/005* (2013.01); *B66B 23/24* (2013.01); *B66B 31/02* (2013.01); *B66B 21/02* (2013.01)

(58) Field of Classification Search

CPC ..... B66B 31/02; B66B 21/02; B66B 23/24; B66B 29/005

USPC ..... 198/322

See application file for complete search history.

(56) References Cited

U.S. PATENT DOCUMENTS

| | | | | |
|---|---|---|---|---|
| 4,976,345 | A | 12/1990 | Adrian et al. | |
| 5,072,820 | A | 12/1991 | Steffen et al. | |
| 5,092,446 | A | 3/1992 | Sullivan et al. | |
| 5,645,146 | A * | 7/1997 | Bieber | A45C 5/14 190/115 |
| 8,061,215 | B2 | 11/2011 | Caunce et al. | |
| 2003/0136635 | A1 | 7/2003 | Lauch | |
| 2015/0009015 | A1 | 1/2015 | Nakata et al. | |
| 2018/0364375 | A1* | 12/2018 | Naughton | G01V 1/28 |
| 2019/0002217 | A1* | 1/2019 | Ramos | E01D 15/24 |

FOREIGN PATENT DOCUMENTS

| | | | | |
|---|---|---|---|---|
| CN | 1030304 C | * | 11/1995 | B66B 29/04 |
| CN | 105366524 A | | 3/2016 | |
| CN | 205170137 U | | 4/2016 | |
| CN | 106144872 | | 11/2016 | |

(Continued)

OTHER PUBLICATIONS

Derwent ACC-No. 2018-32498L (Pub-No. CN207258983 (Year: 2018).*

(Continued)

*Primary Examiner* — Gene O Crawford
*Assistant Examiner* — Lester Rushin, III
(74) *Attorney, Agent, or Firm* — Cantor Colburn LLP

(57) ABSTRACT

Disclosed is an escalator system including handrail, the system having: a handrail including a handrail base and a handrail cover operationally connected to the handrail base, a first sensor disposed between the handrail base and the handrail cover and a first controller for controlling the first sensor, and wherein the first sensor processes data representing a sensed parameter, whereby the system identifies the occurrence of a trigger event and executes a first responsive measure.

8 Claims, 7 Drawing Sheets

(56) References Cited

FOREIGN PATENT DOCUMENTS

| | | | | | |
|---|---|---|---|---|---|
| CN | 106167226 | A | * | 11/2016 | |
| CN | 205932893 | | | 2/2017 | |
| CN | 106744230 | | | 5/2017 | |
| CN | 106744230 | A | * | 5/2017 | |
| CN | 206955426 | U | | 2/2018 | |
| EP | 0960847 | A1 | | 12/1999 | |
| JP | 2005247483 | | | 9/2005 | |
| JP | 2005343647 | A | | 12/2005 | |
| KR | 101209305 | B1 | | 12/2012 | |
| KR | 101622825 | B1 | | 5/2016 | |
| WO | 2004014774 | A1 | | 2/2004 | |
| WO | WO2004014174 | | * | 2/2004 | |
| WO | WO-2004014774 | A1 | * | 2/2004 | ..... B66B 27/00 |

OTHER PUBLICATIONS

European Search Report; Application No. 19191345.8; dated Feb. 27, 2020; 7 pages.
Chinese Office Action; Application No. 201910734948.2; dated Jun. 30, 2020; 8 pages.

* cited by examiner

ESCALATOR SYSTEM WITH SAFETY SENSOR

CROSS-REFERENCE TO RELATED APPLICATION

This application claims the benefit of Indian Patent Application No. 201811030190, filed Aug. 10, 2018, which is hereby incorporated by reference in its entirety.

BACKGROUND

The embodiments herein relate to operation of an escalator system and more specifically to an escalator system with one or more safety sensors.

Escalator safety related incidents are known to occur based on passenger behavior, including when adults and children lean on an escalator handrail. Handrails may malfunction as a result of such misuse.

BRIEF SUMMARY

Disclosed is an escalator system including handrail, the system comprising: a handrail including a handrail base and a handrail cover operationally connected to the handrail base, a first sensor disposed between the handrail base and the handrail cover and a first controller for controlling the first sensor, and wherein the first sensor processes data representing a sensed parameter, whereby the system identifies the occurrence of a trigger event and executes a first responsive measure.

In addition to one or more of the above disclosed features and elements, or as an alternate, the sensed parameter is one or more of pressure, force, weight, impulse and displacement.

In addition to one or more of the above disclosed features and elements, or as an alternate, the system identifies the occurrence of a trigger event when system determines that data processed by the first sensor indicates the sensed parameter applied to the handrail cover is greater than an acceptable limit.

In addition to one or more of the above disclosed features and elements, or as an alternate, the system comprises a plurality of sensors including the first sensor and a second sensor, the plurality of sensors being spaced on the handrail cover, and wherein the plurality of sensors processes data representing the sensed parameter, whereby the system identifies the occurrence of the trigger event.

In addition to one or more of the above disclosed features and elements, or as an alternate, the system identifies the occurrence of the trigger event when the system determines that data processed by the first sensor and the second sensor indicate the sensed parameter applied to the handrail cover is greater than the acceptable limit.

In addition to one or more of the above disclosed features and elements, or as an alternate, the first sensor and second sensor are lengthwise adjacent along a lengthwise span of the handrail cover.

In addition to one or more of the above disclosed features and elements, or as an alternate, the plurality of sensors are mutually spaced by a same spacing interval.

In addition to one or more of the above disclosed features and elements, or as an alternate, the system comprises an escalator, a plurality of controllers including the first controller and a second controller, the second controller being an escalator controller that operationally controls the escalator and communicates with the plurality of sensors, wherein the plurality of sensors processes the sensed data by transmitting the sensed data to the escalator controller, and the escalator controller receives the transmitted sensor data, identifies the occurrence of the trigger event, and executes the first responsive measure, and wherein the first responsive measure is one or more of stopping the escalator and providing an alert.

In addition to one or more of the above disclosed features and elements, or as an alternate, the escalator comprises a plurality of escalator components, including: steps, the handrail assembly, a balustrade supporting the handrail assembly, a plurality of landings including a top landing and a bottom landing, and the first responsive measure includes providing the alert, the alert being a visual alert and/or an audible alert, wherein the alert is provided on one or more of the plurality of escalator components.

In addition to one or more of the above disclosed features and elements, or as an alternate, while executing the first responsive measure, the escalator monitors handrail status may continue to receive transmitted data from the plurality of sensors, identify an ending of the trigger event, and thereafter end the first responsive measure.

Further disclosed is a method of operating a handrail for an escalator system, the system having one or more of the above disclosed features and elements.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
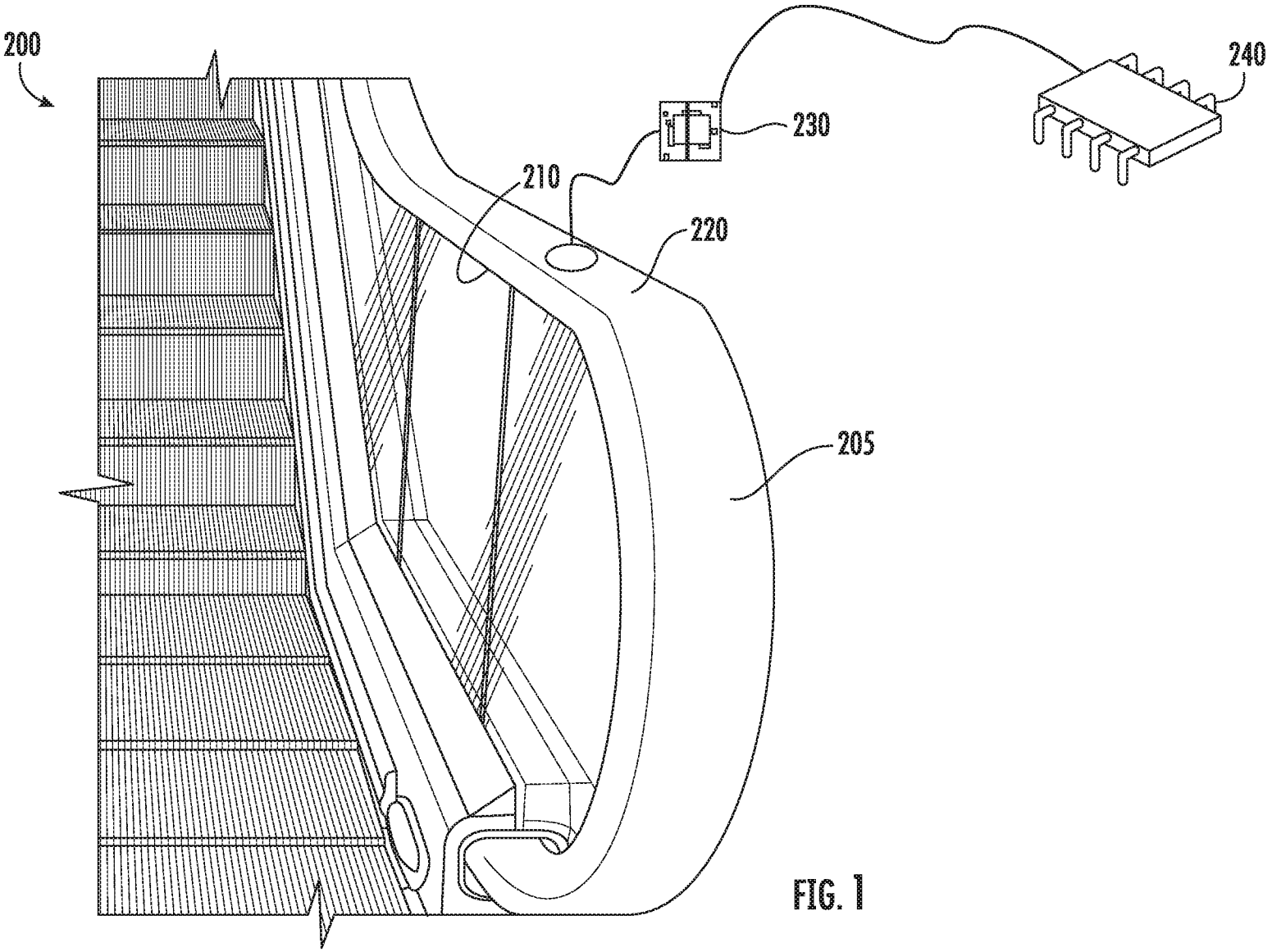
FIG. 1 illustrates components of an escalator system according to an embodiment.

Turning to FIG. 1, disclosed is an escalator system 200. The system 200 may comprise a handrail assembly 205 that includes a handrail base 210 and a handrail cover 220 operationally connected to the handrail base 210. Not disclosed herein are typical components of a handrail base 210, including a slider, tension member disposed exterior to the slider, and inner components disposed exterior to the tension member. The system 200 may include a first sensor 230 disposed between the handrail base 210 and the handrail cover 220, and a first controller 240 for controlling the first sensor 230. The first controller 240 may be an on-board controller for the first sensor 230.

Reference in this document to operational features of the first sensor 230 may also be construed as reference to the first controller 240 for implementing controls necessary to support such operational features. Other components and related controllers disclosed herein shall be similarly construed.

Figure 2:
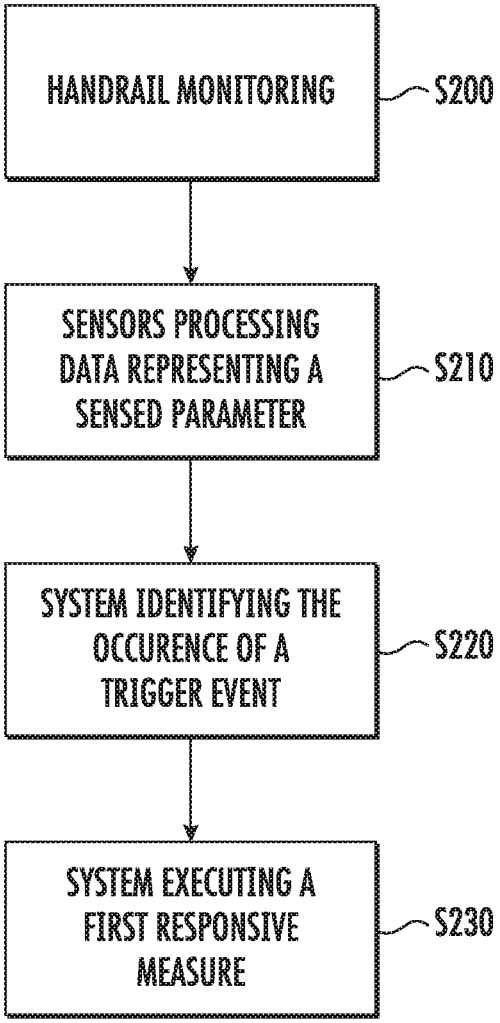
FIG. 2 illustrates a process related to the components in FIG. 1.

Turning to FIG. 2, disclosed is process S200 of handrail monitoring by the system 200. Process steps are sequentially numbered in this document to facilitate discussion but are not intended to identify a specific sequence of preformation such steps or a requirement to perform such steps unless expressly indicated. The first sensor 230 may perform step S210 of processing data representing a sensed parameter. The sensed parameter may be one or more of pressure, force, weight, impulse and displacement. From this transmission, the system 200 may perform step S220 of identifying the occurrence of a trigger event. Thereafter the system 200 may perform step S230 of executing a first responsive measure.

More specifically, the system 200 may identify the occurrence of a trigger event when the system 200 determines that data processed by the first sensor 230 indicates the sensed parameter applied to the handrail cover 220 is greater than an acceptable limit. For example, a predetermined limit for applied weight may be a certain number of pounds. Accordingly, a trigger event may occur when the system 200 identifies the applied weight sensed by the first sensor 230 is, for example, one or more pounds above the predetermined limit.

Figure 3:
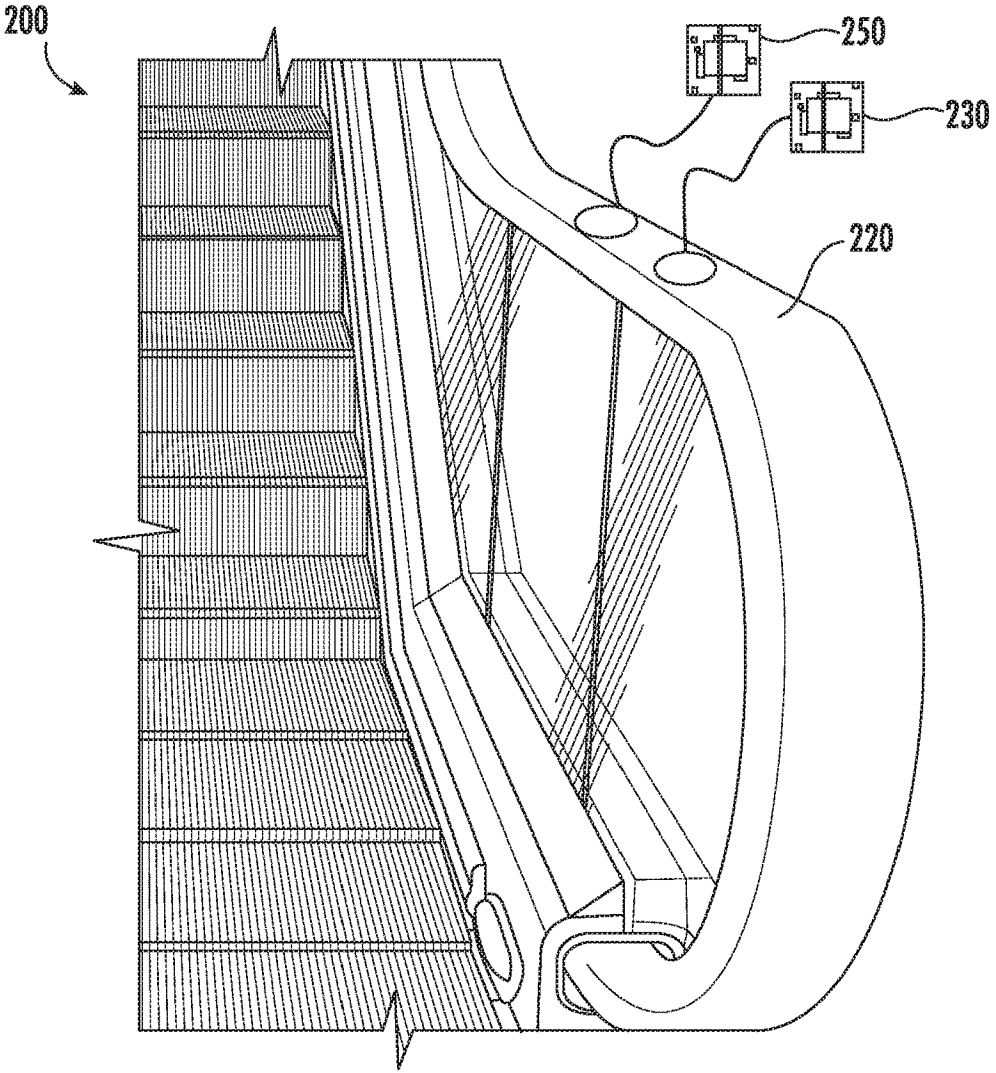
FIG. 3 illustrates further components of an escalator system according to an embodiment.

Turning to FIG. 3, the system 200 may include a plurality of sensors, including the first sensor 230 and a second sensor 250, spaced on the handrail cover 220. The plurality of sensors may be operationally the same as the first sensor 230. According to an embodiment the plurality of sensors may process data representing the sensed parameter. From this data the system 200 may identify the occurrence of the trigger event. According to an embodiment, the system 200 may determine that data processed by the first sensor 230 and the second sensor 250 indicate the sensed parameter applied to the handrail cover is greater than the acceptable limit.

Figure 4:
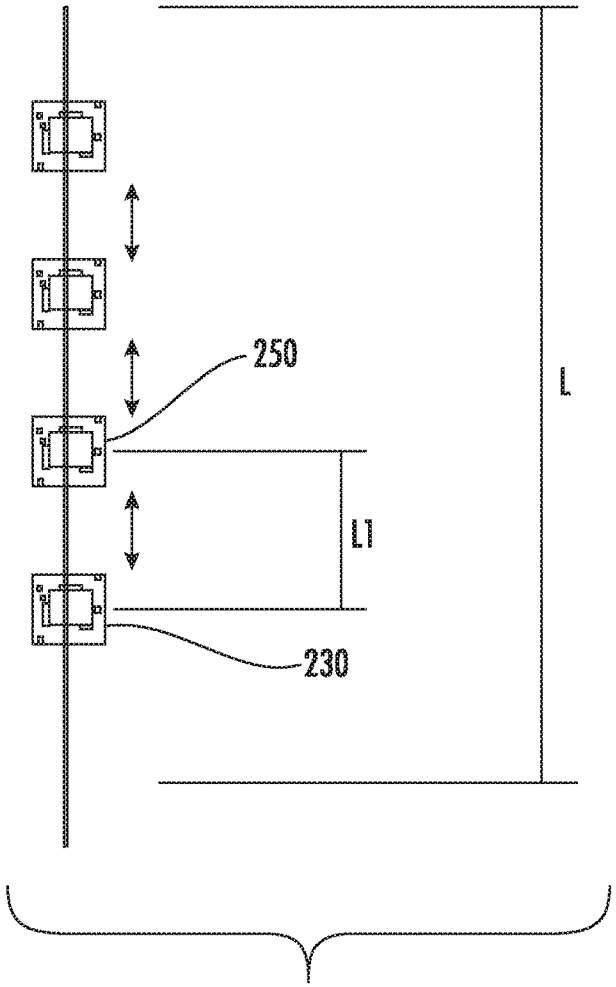
FIG. 4 illustrates further components of an escalator system according to an embodiment.

As illustrated in FIG. 4, the first sensor 230 and second sensor 250 may be lengthwise adjacent along a lengthwise span L of the handrail cover 220. According to an embodiment the plurality of sensors may be mutually spaced by a same spacing interval L1. The spacing interval L1 may be for example three inches, though such increment is not intended to be limiting.

Figure 5:
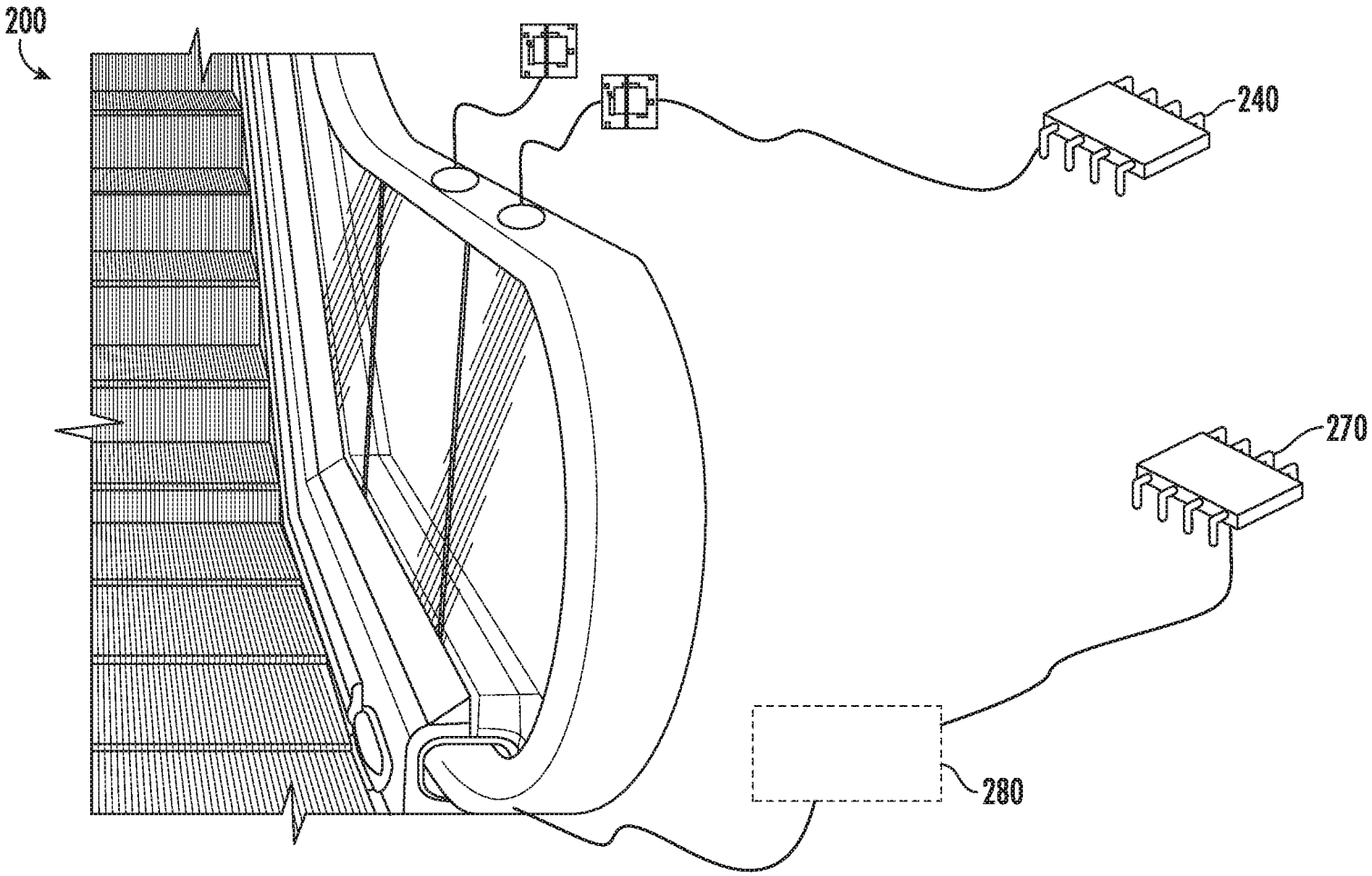
FIG. 5 illustrates further components of an escalator system according to an embodiment.

Turning to FIG. 5, the system 200 may include an escalator 260. In addition, the system 200 may include a plurality of controllers including the first controller 240 and a second controller 270. The second controller 270 may be an escalator controller that controls operational parameters of the escalator 260 and communicates with the plurality of sensors. The second controller 270 may be housed, for example, within an electronic control hub 280, illustrated schematically, housed within or proximate to the escalator 260.

Figure 6:
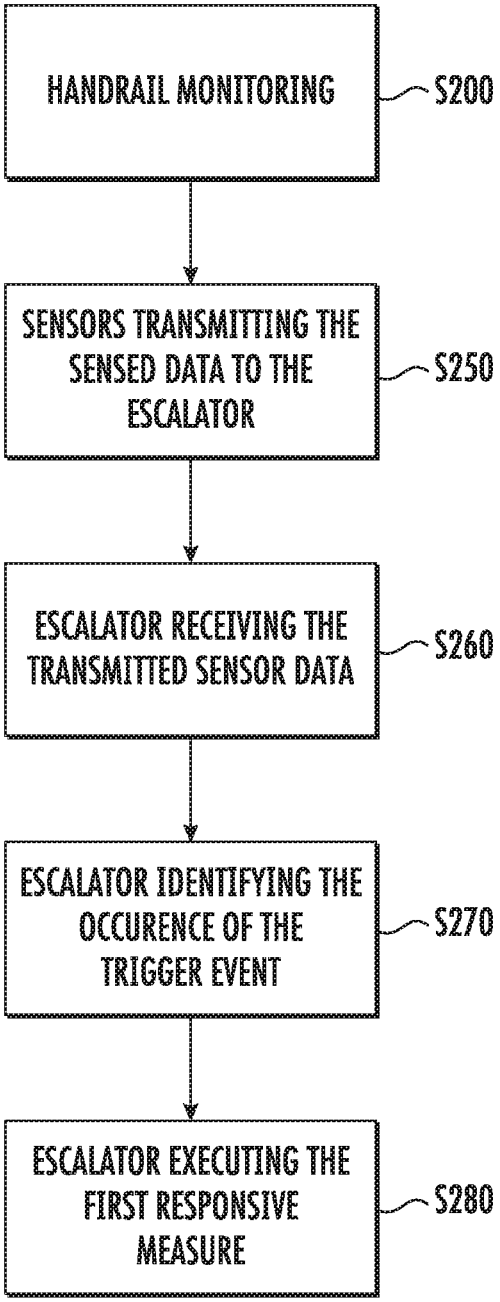
FIG. 6 illustrates a process related to the components in FIG. 5.

Turning to FIG. 6, for the monitoring process S200, the plurality of sensors processes the sensed data at step S250 by transmitting the sensed data to the escalator 260. The escalator 260 performs step S260 of receiving the transmitted sensor data, step S270 of identifying the occurrence of the trigger event, and step S280 of executing the first responsive measure. According to an embodiment the first responsive measure executed by the escalator 260 may be one or more of stopping the escalator 260 and providing an alert.

Figure 7:
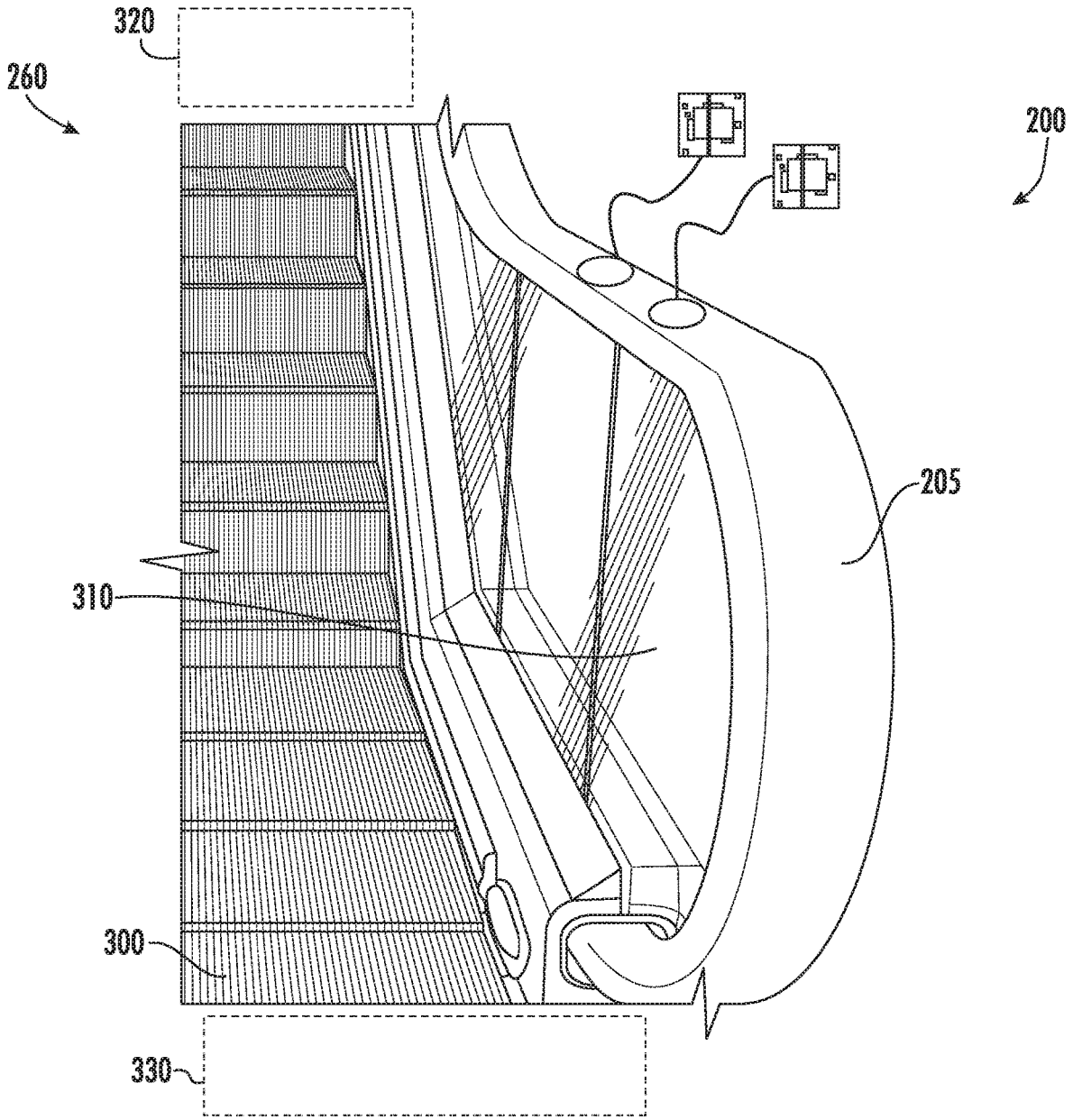
FIG. 7 illustrates further components of an escalator system according to an embodiment.

Turning to FIG. 7, the escalator 260 may comprise a plurality of escalator components, including steps 300, the handrail assembly 205, a balustrade 310 supporting the handrail assembly 205, and a plurality of landings including a top landing 320 and a bottom landing 330, both illustrated schematically. Not illustrated herein are typical internal support structures for the steps 300, including a track disposed on a truss.

According to an embodiment the first responsive measure may include providing the alert, wherein the alert being a visual alert and/or an audible alert, and wherein the alert is provided from one or more of the escalator components. For example, speakers and/or a series of lights may be integrated into the escalator components such as the steps 300, the balustrade 310, the handrail cover 220 or other part of the handrail assembly 205, and the landings. The escalator 260 may stop the handrail and/or provide an alert including one or more of a tone, verbal warning and flashing lights, to indicate when the trigger event has occurred. Passengers, alerted to the trigger event, may then use the handrail assembly appropriately in order to end the trigger event.

Figure 8:
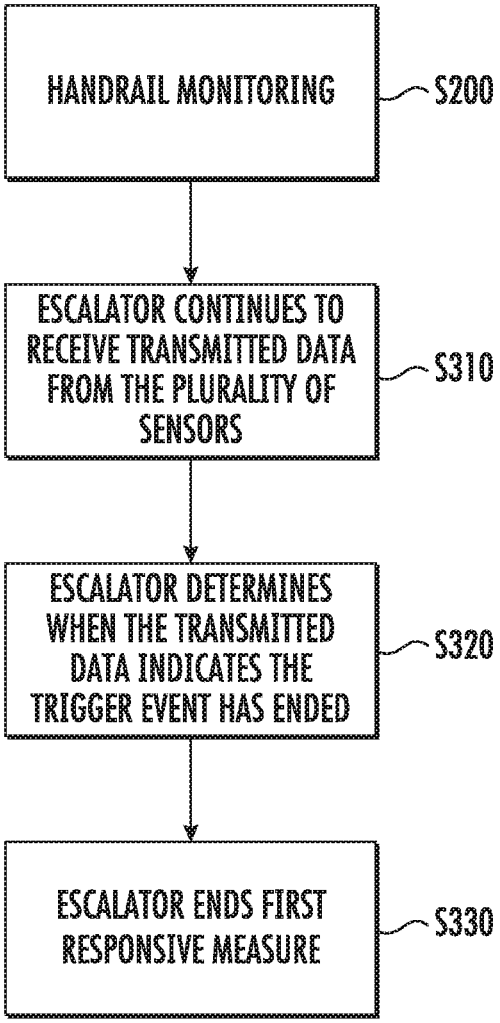
FIG. 8 illustrates a process related to the components in FIG. 7.

Turning to FIG. 8, the handrail monitoring process S200 may include additional steps while effecting the first responsive measure. At step S310 the escalator 260 may continue to receive transmitted data from the plurality of sensors. At step S320 the escalator 260 may determine when the transmitted data indicates the trigger event has ended. For example, the transmitted data may indicate that the sensed parameter applied to the handrail cover 220 is below the acceptable limit. Then at step S330 the escalator 260 may end the first responsive measure. That is, the escalator 260 may resume normal operation.

The above disclosed embodiments provide a safeguard for passengers and handrail equipment using weight-force-pressure sensing devices between a handrail and handrail base. A multiple of such devices may be placed at mutually equivalent distances. The sensing devices may sense the weight-force application by passengers on the handrail. A default weight-force input at each sensor device may be configured for certain limits. When the weight from two or more consecutive sensing devices is more than the configured limits, an additional force may be acting on handrail. For example, passengers may be leaning on a handrail for support or, for example, children attempting to play. The disclosed embodiments may provide safeguard that prevents damage from occurring to the handrail and injuries from occurring to passengers.

The above disclosed embodiments provide a handrail movement that may be suspended to avoid damage to the handrail and injury to passengers. The disclosed embodiments may provide an alarm that is sounded so that other passengers and perhaps security personnel may be alerted to assist in the safeguarding process both for the equipment and themselves.

The above disclosed system comprises a conveyance system that moves passengers between floors and/or along a single floor. Such conveyance systems are identified herein as escalators, however other application to other forms of people movers is considered within the scope of the disclosure.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An escalator system comprising:

a handrail including a handrail base and a handrail cover operationally connected to the handrail base, a first sensor disposed between the handrail base and the handrail cover and a first controller for controlling the first sensor, and wherein the first sensor processes data representing a sensed parameter, whereby the system identifies the occurrence of a trigger event and executes a first responsive measure, and wherein:

the sensed parameter is one or more of pressure, force, weight, impulse and displacement;

the system includes a plurality of sensors, including the first sensor and a second sensor, the plurality of sensors being disposed between the handrail base and the handrail cover and lengthwise spaced along a lengthwise span of the handrail cover by a same spacing interval so that the first sensor and second sensor are lengthwise adjacent along the lengthwise span of the handrail cover, the plurality of sensors processes data representing the sensed parameter, whereby the system identifies the occurrence of the trigger event, and the system identifies the occurrence of the trigger event when the system determines that data processed by two or more adjacent ones of the plurality sensor indicate the sensed parameter applied to the handrail cover is greater than the acceptable limit.

2. The system of claim 1, comprising an escalator, a plurality of controllers including the first controller and a second controller, the second controller being an escalator controller that operationally controls the escalator and communicates with the plurality of sensors, wherein the plurality of sensors processes the sensed data by transmitting the sensed data to the escalator controller, and the escalator controller receives the transmitted sensor data, identifies the occurrence of the trigger event, and executes the first responsive measure, and wherein the first responsive measure is one or more of stopping the escalator and providing an alert.

3. The system of claim 2 wherein the escalator comprises a plurality of escalator components, including:

steps, the handrail assembly, a balustrade supporting the handrail assembly, a plurality of landings including a top landing and a bottom landing, and the first responsive measure includes providing the alert, the alert being a visual alert and/or an audible alert, wherein the alert is provided on one or more of the plurality of escalator components.

4. The system of claim 3 wherein while executing the first responsive measure, the escalator monitors handrail status to receive transmitted data from the plurality of sensors, identifies an ending of the trigger event, and thereafter ends the first responsive measure.

5. A method of operating a handrail for an escalator system, the system comprising:

a handrail assembly including a handrail base and a handrail cover operationally connected to the handrail base, a first sensor disposed between the handrail base and the handrail cover and a first controller for controlling the first sensor, and wherein the first sensor processes data representing a sensed parameter, whereby the system identifies the occurrence of a trigger event and executes a first responsive measure, and wherein:

the sensed parameter is one or more of pressure, force, weight, impulse and displacement, the system includes a plurality of sensors, including the first sensor and a second sensor, the plurality of sensors being lengthwise spaced on the handrail cover by a same spacing interval so that the first sensor and second sensor are lengthwise adjacent along a lengthwise span of the handrail cover, the plurality of sensors processes data representing the sensed parameter, whereby the system identifies the occurrence of the trigger event, and the system identifies the occurrence of the trigger event when the system determines that data processed by two or more adjacent ones of the plurality sensor indicate the sensed parameter applied to the handrail cover is greater than the acceptable limit.

6. The method of claim 5 wherein the system comprises an escalator, a plurality of controllers including the first controller and a second controller, the second controller being an escalator controller that operationally controls the escalator and communicates with the plurality of sensors, wherein the plurality of sensors processes the sensed data by transmitting the sensed data to the escalator controller, and the escalator controller receives the transmitted sensor data, identifies the occurrence of the trigger event, and executes the first responsive measure, and wherein the first responsive measure is one or more of stopping the escalator and providing an alert.

7. The method of claim 6 wherein the escalator comprises a plurality of escalator components, including:

steps, the handrail assembly, a balustrade supporting the handrail assembly, a plurality of landings including a top landing and a bottom landing, and the first responsive measure includes providing the alert, the alert being a visual alert and/or an audible alert, wherein the alert is provided on one or more of the plurality of escalator components.

8. The method of claim 7 wherein while executing the first responsive measure, the escalator monitors handrail status to receive transmitted data from the plurality of sensors, identifies an ending of the trigger event, and thereafter ends the first responsive measure.

* * * * *